US005211575A

United States Patent [19]

Ustin

[11] Patent Number: 5,211,575

[45] Date of Patent: May 18, 1993

[54] INSULATED PIGTAIL DEVICE

[75] Inventor: George Ustin, New York, N.Y.

[73] Assignee: Buchanan Construction Products, Inc., Hackettstown, N.J.

[21] Appl. No.: 903,122

[22] Filed: Jun. 23, 1992

[51] Int. Cl.[5] ..... H01R 4/24

[52] U.S. Cl. ..... 439/417

[58] Field of Search ..... 439/389–425

[56] References Cited

U.S. PATENT DOCUMENTS 3,012,219 12/1961 Levin et al. .
3,118,715 1/1964 Potruch .
3,202,957 8/1965 Leach .
3,836,944 9/1974 Lawson .
3,892,460 7/1975 Izraeli .
3,899,236 8/1975 Santos .
3,912,356 10/1975 Johansson .
4,326,767 4/1982 Silbernagel et al. .
4,820,191 4/1989 Lacroix .
4,891,018 1/1990 Afflerbaugh et al. .
4,964,811 10/1990 Hayes, Sr. et al. .

*Primary Examiner*—Joseph H. McGlynn

*Attorney, Agent, or Firm*—Kinzer, Plyer, Dorn, McEachran & Jambor

[57] ABSTRACT

A wire connector for simultaneously connecting a plurality of insulated conductors, without stripping or twisting the conductors, and which conductors may be of the same or a different wire gauge. There is a housing which has a plurality of openings for the insertion of insulated conductors. A plurality of wire guides are positioned within the housing and extend transverse to insulated conductors positioned within the housing for connection. Each wire guide has openings in alignment with the housing openings, with the openings in each wire guide being of the same size, but with the openings in successive wire guides decreasing in size with the wire guide with the smallest openings being furthest from the housing openings. The wire guides function as a positive stop, limiting the insertion of the insulated conductors in accordance with the size of the conductors. A conductive indentor having a plurality of insulation piercing projections extends between the wire guides for penetrating the conductor insulation to interconnect conductors positioned in the wire guide openings.

19 Claims, 2 Drawing Sheets

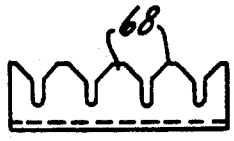
Fig.10.
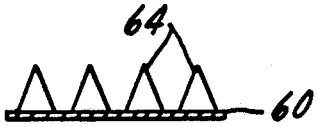
Fig.11.
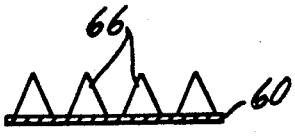
Fig.12.
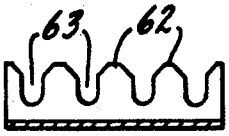
Fig.13.
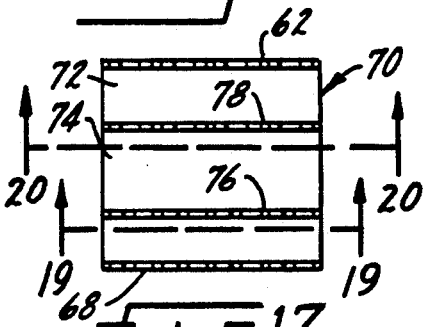
Fig.17.
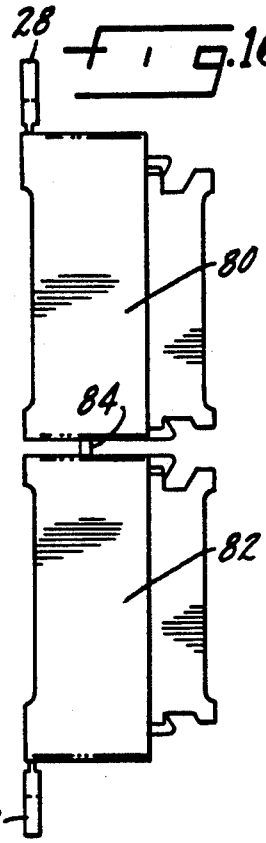
Fig.16.
Fig.14.
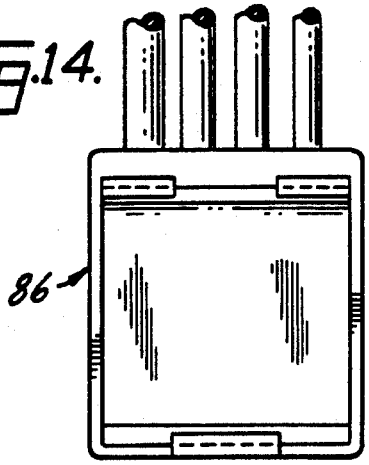
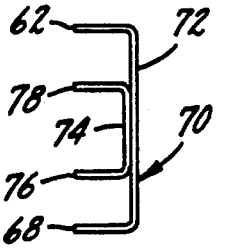
Fig.18.
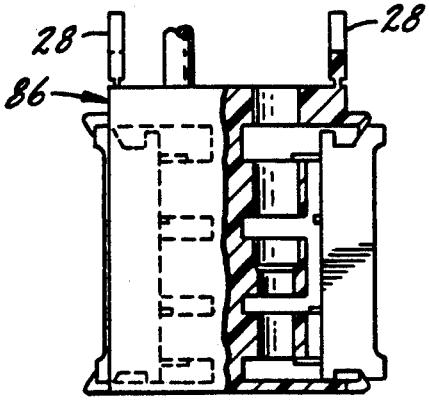
Fig.15.
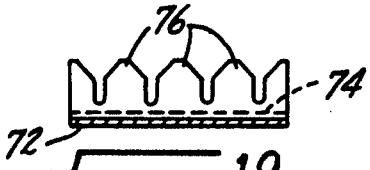
Fig.19.
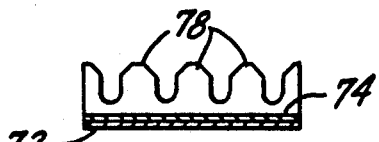
Fig.20.

INSULATED PIGTAIL DEVICE

THE FIELD OF THE INVENTION

The present invention is in the field of wire connectors for connecting insulated conductors. There are many such devices on the market, most of which require that the insulated conductors be stripped and twisted to make the electrical connection. There is also on the market another form of connector in which insulated wires may be positioned within a housing and when the two parts of the housing are closed, the insulation is pierced by an electrically conductive element within the housing to interconnect the conductors. The present invention is specifically directed to a wire connector which utilizes the technique of piercing insulated conductors with a conductive element. The unstripped and untwisted conductors are positioned within a wire connector housing in which there are a plurality of parallel spaces for the conductors. Wire guides within the housing properly align the conductors and also provide a stop, limiting the distance to which conductors may extend within the housing, depending upon the gauge of the conductor. The spaces between the wire guides direct the insulation piercing conductors and are of a width just sufficient to receive the projections, thereby preventing the projections from being bent and not making contact with the wire inside of the conductor insulation.

SUMMARY OF THE INVENTION

The present invention relates to wire connectors and particularly to a wire connector which may connect a plurality of insulating conductors of different sizes without either stripping or twisting the conductors.

A primary purpose of the invention is to provide a wire connector which simultaneously connects a multitude of conductors of varying wire gauge without stripping and/or twisting the conductors.

Another purpose of the invention is to provide a wire connector wherein the conductors are guided and located with respect to the insulation displacement device so that secure and adequate penetration by such device is assured.

Another purpose of the invention is to provide a wire connector in which conductors are temporarily held in position while other conductors are inserted, all prior to completing the application of the wire connector to the conductors.

Another purpose of the invention is to provide a wire connector which may interconnect insulated conductors of varying size using conventional pliers.

Another purpose of the invention is to provide a wire connector of the type described which is reusable.

Another purpose is a wire connector for simultaneously electrically connecting a multitude of conductors which is labor saving as it eliminates stripping and/or twisting of the wire ends.

Another purpose is a wire connector assembly in which multiple wire connectors of the type described may be attached together.

Other purposes will appear in the ensuing specification, drawings and claims.

BRIEF DESCRIPTION OF THE DRAWINGS

The invention is illustrated diagrammatically in the following drawings wherein

FIG. 10 is a side view of the indentor along plane 10—10 of FIG. 9;

FIG. 11 is a section of the indentor assembly along plane 11—11 of FIG. 9;

FIG. 12 is a section of the indentor assembly along plane 12—12 of FIG. 9;

FIG. 13 is a section of the indentor assembly along plane 13—13 of FIG. 9;

FIG. 14 is a top plan view of a further embodiment of wire connector with insulated conductors positioned therein;

FIG. 15 is a side view, in partial section, of the wire connector embodiment of FIG. 14;

FIG. 16 is a side view of a further embodiment of wire connector;

FIG. 17 is a plan view of a further form of indentor assembly;

FIG. 18 is a side view of the indentor assembly of FIG. 17;

FIG. 19 is a section of the indentor assembly along plane 19—19 of FIG. 17; and FIG. 20 is a section of the indentor assembly along plane 20—20 of FIG. 17.

DESCRIPTION OF THE PREFERRED EMBODIMENT

Figure 1:
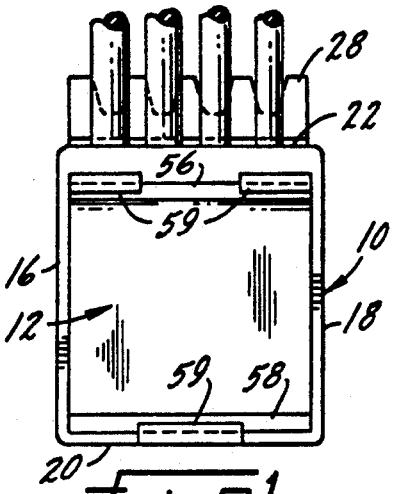
FIG. 1 is a top plan view of a wire connector of the type described showing insulated conductors positioned therein.

The wire connector of the present invention consists of three elements: a housing 10, a cover for the housing indicated at 12, and an indentor 14. The housing 10 includes side walls 16 and 18, rear wall 20 and a front wall 22. There is a bottom 24 and the entire housing may be formed of plastic and molded as a single unit.

The front wall 22 of housing 10 has a plurality of adjoining equally sized wire conductor openings 26. Adjacent openings 26 and extending from front wall 22 are a plurality of tapered projections 28 which define generally V-shaped spaces 30 therebetween. Each space 30 is in alignment with an opening 26 and the spaces or slots serve as a means of temporarily holding a conductor in position, once it has been inserted through an opening 26 and into housing 10.

Formed within housing 10 are a plurality of wire guides indicated at 32, 34 and 36. Wire guide 32 has a plurality of openings 38 which are coaxially aligned with front openings 26 and are of the same size. Wire guide 34 has a plurality of openings 40 which are coaxially aligned with openings 38 and 26, and have a portion **40*a* equal in size to openings 38 and a portion 40*b* slightly smaller than openings 38. A stop 40*c* separates the unequal sized opening portions 40*a* and 40*b*. Wire guide 36 has a plurality of openings 42 which again are coaxially aligned with the previously-mentioned openings, and are equal in size to the slightly smaller opening portions 40***b*.

In use, when a plurality or multiple of insulated conductors are to be electrically connected, conductors having a wire size smaller than openings 26 and openings 38 and larger than openings 42 will only pass through openings 26, through wire guide 32 and through wire guide 34 up to stop 40*c*. An insulated conductor of a smaller size will pass through the openings in all three wire guides. Shoulder 40*c* in wire guide 34 functions as a stop limiting the extent to which larger insulated conductors may be inserted into the housing. The different size openings in the wire guides and the stop in wire guide 34 limit the depth of insertion of the conductors. The openings do however provide a means for holding inserted conductors in a given position for subsequent penetration of the insulation by the indentor to electrically connect the wires.

There is a space 44 between wire guide 32 and the front wall 22 of housing 10. Similarly, there is a space 46 between wire guides 32 and 34, a space 48 between wire guides 34 and 36 and a space 50 between wire guide 36 and rear wall 20. The size and function of these spaces will be described hereinafter.

Indentor cover 12 has a generally rectangular-shaped cavity 52 to house indentor 14. Space 52 is defined by walls 54 and opposite ends of the outer surface of cover 12 may have projections 56 and 58 which will interlock with hooks 59 extending from housing walls 20 and 22 to firmly hold the cover in position on the housing after the wire connector has been assembled.

The opposite ends of the cover also have projections 56*a* and 58*a* which interlock with hooks 59 to hold the cover in a partially open captive position. The cover is so assembled to housing 10 at the factory. Once the wires have been inserted, the cover will be fully closed.

Figure 9:
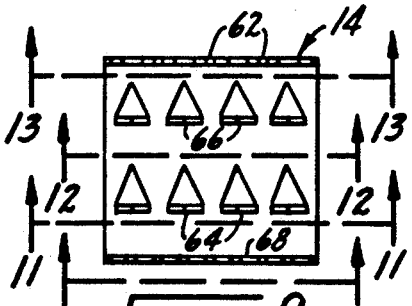
FIG. 9 is a plan view of the indentor assembly.

The indentor assembly 14, which is preferably made of a thin gauge electrically conductive metal, includes a base 60 and four rows of insulation penetrating projections indicated at 62, 64, 66 and 68. As shown particularly in FIGS. 9–13, the projections vary in size and configuration. Projections 62, which will be positioned in space 44 when the indentor is assembled onto the housing, have the smallest size projections with the largest gap between projections. This is to accommodate the largest size insulated conductors which are positioned in the housing and will only pass through the wire guide openings up to stop 40*c*. The wire conductors will fit in the spaces 63 between projections and the insulation will be penetrated by the sides of the projections. Projections 64 and 66 are in the form of teeth and the points of the projections will pierce the insulation. The spaces between the wire guides which will receive the projections are only slightly larger than the thickness of the metal forming the projections. This insures that the projections or teeth will not bend and will be forced to penetrate the insulation and contact the internal conductors. Projections 64 and 66 are of the same size, and projections 68 which are positioned in space 50 have a smaller space between projections and function in the same manner as projections 62 in that the sides of the projections penetrate the conductor insulation. The variant size projections will insure that all conductors, regardless of size, which can be received within the openings of the housing, will have the insulation pierced and there will be metal-to-metal contact between the indentor and the wire conductors. Thus, the variant size conductors will all be interconnected.

It is advantageous to form the indentor 14 out of a single stamping. Thus, the projections 64 and 66 will be cut out of body 60 and the end projections 62 and 68 will be cut or formed in the stamping process. It should be noted that the depth of the projections varies in that projections 62 and 68 extend a greater distance into the housing than projections 64 and 66. This is due to the fact that in projections 64 and 66 it is the point of the projection which actually penetrates rather than the sides, as in projections 62 and 68.

A variant form of indentor is shown in FIGS. 17 through 20. In this instance all projections are of the same depth and all penetrate conductor insulation from the side. Indentor 70 is made from two stampings, indicated at 72 and 74. Stamping 72 provides the end projections which can be the same as projections 62 and 68 shown in FIGS. 10 and 13. The intermediate projections formed from stamping 74 are indicated in FIGS. 19 and 20, with the intermediate projections being designated at 76 and 78. It should be noted that projections 78 are essentially the same as projections 62 in that they will accommodate larger wire sizes and these projections will fit within the space 46 between wire guides 32 and 34. Projections 76 are the same as projections 68 and these projections will fit within space 48 between wire guides 34 and 36.

All indentors function in essentially the same manner in that there are projections which will pierce the insulation of the conductors to be in metallic contact with the wires. The essential difference in the two types of indentors relates to manufacturing considerations.

In use, the wire conductors will be placed at random in the housing by being first passed through openings 26 and then through openings in the wire guides, depending upon the size of the conductor. After a particular conductor has been passed through opening 26, it can be bent over and held in the space 30 between adjacent projections 28. This insures that the conductor will not accidentally be removed from the housing once it has been so positioned during the time that the electrician is placing other conductors in the housing. Once all of the conductors are properly placed within the housing, cap 12 with the indentor 14 positioned within the cavity 52 will be pushed closed, with the projections 56 and 58 and hooks 59 insuring that there is an interlock between the cap and the housing so that the wire connector is fully closed. Normally, a pair of electrician's pliers will be used to firmly push these two elements together so as to prevent accidental opening.

The wire connector is reusable in that the cover 12 may be removed and the indentor reused as the projections or teeth on the indentor will not be bent because of their confinement between the adjacent wire guides. When the connector is to be reused, projections 56 and 58 will be released from hooks 59, however, the cover will be loosely held to the housing by projections 56*a* and 58*a*.

In some applications it is advantageous for the electrician to have wire connectors of the type described herein attached together to form a wire connector assembly. FIG. 16 shows one such arrangement in which a pair of wire connectors such as described in connection with the earlier figures, and indicated at 80 and 82, are connected by a connecting rib 84 which may be integral with the housings of both connectors. Wires would be inserted from the upper end of connector 80 and from the lower end of connector 82. The rib 84 may be of sufficient flexibility that the wire connectors can be bent into different positions to accommodate the particular needs of the wiring job or can be cut if space is a problem.

Figure 2:
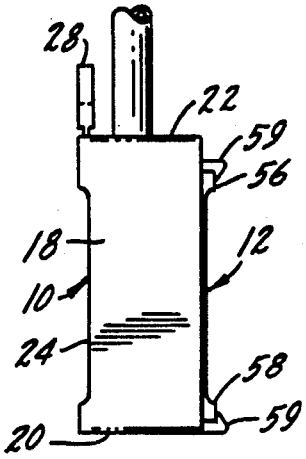
FIG. 2 is a side view of the connector of FIG. 1 with insulated conductors positioned therein.
Figure 3:
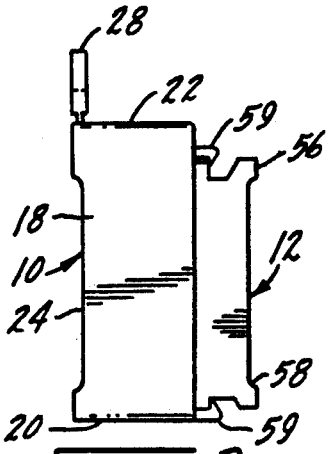
FIG. 3 is a side view of the wire connector showing the cover in a release position.
Figure 4:
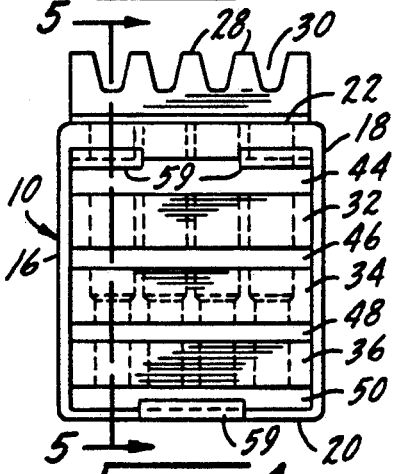
FIG. 4 is a top view of the wire connector housing with the conductor paths shown in phantom.
Figure 5:
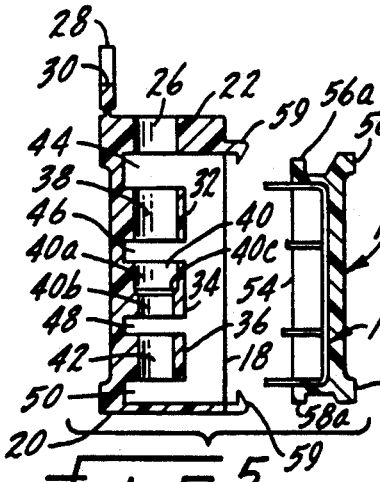
FIG. 5 is an exploded section along plane 5—5 of FIG. 4.
Figure 6:
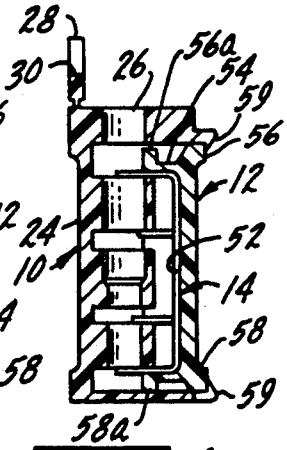
FIG. 6 is a section, similar to FIG. 5, showing the wire connector in a closed position.
Figure 7:
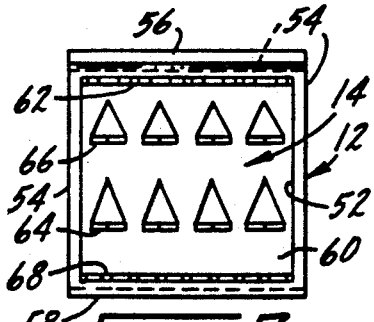
FIG. 7 is a plan view of the indentor assembly positioned within the connector cover.
Figure 8:
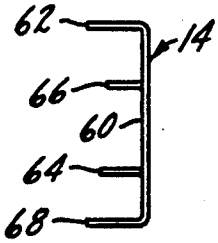
FIG. 8 is a side view of the indentor assembly.

A second form of the invention utilizing multiple wire connectors in a single wire connector assembly is shown in FIGS. 14 and 15. In this instance, two wire connectors of the type shown in FIGS. 1 through 13 are molded together back to back with a common bottom wall. The assembly 86 may be in all respects the FIG. 1–13 embodiment connectors and wires will be inserted, as shown in FIG. 15 from the same end of the assembly. In the alternative, one set of wires could be entered into one wire connector from one end, and the other set from the opposite end. The invention has substantial flexibility in terms of multiples of wire connectors.

Although the invention discloses a wire connector in which all of the multiple conductors positioned in it are electrically connected, it should be understood that the concepts of wire guides with variant sized openings and an indentor with various size projections can be used to independently connect multiple groups of wires, depending upon the size of the wire conductor and the number and disposition of the indentors.

Whereas the preferred form of the invention has been shown and described herein, it should be realized that there may be many modifications, substitutions and alterations thereto.

The embodiments of the invention in which an exclusive property are claimed are defined as follows:

1. A wire connector for connecting a plurality of insulated conductors, without stripping or twisting the conductors, which conductors may be of the same or a different wire gauge, said wire connector including a housing having a plurality of openings for the insertion of insulated conductors, a plurality of wire guides within the housing and extending transverse to conductors positioned within the housing, each wire guide having openings therein in alignment with the housing openings, the openings in a particular wire guide being of the same size, with the openings in successive wire guides varying in size with the wire guide with the smallest openings being furthest from the housing openings, and a conductive indentor having a plurality of insulation piercing projections extending between the wire guides for penetrating the conductor insulation to interconnect at least a portion of the conductors positioned in said wire guide openings.

2. The wire connector of claim 1 further characterized in that said housing is formed of two parts, said wire guides being positioned in one part and the indentor being positioned in the other part.

3. The wire connector of claim 1 further characterized in that the housing openings are adjoining and of the same size.

4. The wire connector of claim 3 further characterized in that the wire guide openings are coaxially aligned.

5. The wire connector of claim 1 further characterized in that there are transverse spaces between wire guides to receive the indentor projections

6. The wire connector of claim 5 further characterized in that the spaces between wire guides have a width only slightly greater than the thickness of the indentor projections to prevent bending of the projections and to insure penetration of the insulation.

7. The wire connector of claim 5 further characterized in that the indentor projections are arranged in rows, with the projections in a particular row being of the same size and configuration.

8. The wire connector of claim 7 further characterized in that the size of the projections in different rows varies, with the largest projections extending into the transverse space adjacent the wire guide with the smallest openings.

9. The wire connector of claim 1 further characterized by and including means on the exterior of said housing, adjacent the housing openings, for temporarily holding conductors.

10. The wire connector of claim 9 further characterized in that said temporary holding means include a plurality of projections, with openings therebetween for temporarily holding conductors.

11. A. wire connector for electrically connecting insulated conductors, without stripping or twisting, which conductors may be of the same or different wire gauge, said wire connector including wire guides defining a plurality of parallel conductor holding spaces, said wire guides including a plurality of coaxially aligned openings, with the openings in a particular wire guide being of the sam size, but the openings of adjacent wire guides being different in size, said wire guides further including means for limiting the extent to which a conductor may be inserted in the wire guides, depending on the gauge of the conductor, and a conductive indentor having a plurality of insulation piercing projections for electrically connecting the insulated conductors.

12. The wire connector of claim 11 further characterized in that there is a space between each wire guide which extends transversely of the insulated conductors and which has a width only slightly greater than the thickness of the indentor projections to prevent bending of the projections and to insure penetration of the conductor insulation.

13. The wire connector of claim 11 further characterized in that an intermediate wire guide has an internal stop in each opening to limit penetration of wires into the wire connector.

14. The wire connector of claim 13 further characterized in that the wire guide openings on opposite sides of the wire guide having stops in its openings are of a size equal to that of the intermediate wire guide openings positioned adjacent thereto.

15. The wire connector of claim 11 further characterized in that the indentor has projections of differing depth, with the projections on opposite ends of the indentor extending a greater distance into the wire connector than the intermediate indentor projections.

16. The wire connector of claim 15 further characterized in that at least one row of said projections is in the form of teeth in which the points pierce the insulation of the conductors, with other rows of projections having spaces between projections to receive the insulated conductors, with the sides of the projections piercing the insulation.

17. The wire connector of claim 11 further characterized in that there are a plurality of wire connectors joined together to form an assembly of wire connectors.

18. The wire connector of claim 17 further characterized in that said wire connectors are joined end to end.

19. The wire connector of claim 17 further characterized in that said wire connectors have a common bottom wall.

* * * * *